United States Patent [19]

Baker et al.

[11] 3,966,135

[45] June 29, 1976

[54] NEWSPRINT REWINDER

[76] Inventors: Bill Baker, 2723 Copeland Road, Tyler, Tex. 75701; Frank Patterson, 608 Hood, Palestine, Tex. 75801

[22] Filed: Feb. 18, 1975

[21] Appl. No.: 550,184

[52] U.S. Cl. ..... 242/58.1; 242/67.3 R

[51] Int. Cl.[2] ..... B65H 19/18

[58] Field of Search ..... 242/67.1 R, 67.2, 67.3 R, 242/58, 58.1, 58.4

[56] References Cited

UNITED STATES PATENTS

| | | | |
|---|---|---|---|
| 1,784,412 | 12/1930 | Ball | 242/58.1 |
| 1,924,585 | 8/1933 | Wood | 242/58 X |
| 1,961,685 | 6/1934 | Farley | 242/58.1 |
| 2,047,280 | 7/1936 | Melnick | 242/58.1 |
| 3,386,672 | 6/1968 | Lamon | 242/58.4 X |

*Primary Examiner*—Edward J. McCarthy
*Attorney, Agent, or Firm*—Newton, Hopkins & Ormsby

[57] ABSTRACT

Apparatus is disclosed for supplying paper to a printing press having a plurality of presses for simultaneously printing a plurality of paper webs and power train means for transmitting power to the presses. The apparatus comprises a plurality of paper roll supports with at least one support including a rotatable shaft, and means for coupling the one roll support rotatable shaft with the power train means to wind paper onto the one roll support from another of the roll supports.

9 Claims, 2 Drawing Figures

NEWSPRINT REWINDER

BACKGROUND OF THE INVENTION

This invention relates generally to printing presses, and particularly to apparatus for supplying paper to printing presses of the type adapted to print a plurality of independent paper webs simultaneously.

Machines used in printing newspapers typically include a plurality of presses for simultaneously printing several individual sheets with means provided for simultaneously supplying independent webs of paper to each press for a printing run. The supply means typically includes a set of roll stands upon which independent rolls of paper may be rotatably mounted, and a set of rollers for guiding the webs of paper from each roll to one of the presses.

In performing a press run it is most important that the presses be operated without interruption through the printing of a single edition. A stoppage in the middle of a run creates risks of plate contamination by upsetting the balance of inks and other fluids. Edition deadline may also fail to be met and labor cost increased.

A principle cause of early press shutdowns is premature consumption of paper from one of the supply rolls. Such premature exhaustion of paper necessitates a halting of all the presses. When this is achieved a new roll of paper is mounted to the vacant, or nearly vacant, roll stand and secured to the trailing edge of the consumed roll by paste or tape. Furthermore, even where a new, full roll of paper is mounted to a vacant roll stand it frequently occurs that the paper remaining on yet another of the roll stands is insufficient to complete the run. This in turn necessitates yet another premature termination of the run.

The just described problem of early press shutdown occasioned by premature consumption of paper was previously recognized in U.S. Pat. No. 1,961,685. This patent, as well as others, has provided various approaches towards solving this problem of early press shutdown. Perhaps the most successful approach to date has been the provision of rewind apparatuses for adding paper to partially consumed rolls in advance of the press run to insure supply sufficiency. To accomplish this apparatuses have been provided for driving one or more of the rolls in a direction opposite that of its normal rotation in feeding paper to a press. Unfortunately, these machines have been relatively bulky and expensive, and difficult to connect and disconnect with speed and facility.

Accordingly, it is a general object of the present invention to provide improved apparatuses for supplying paper to printing presses.

More particularly, it is an object of the invention to provide improved apparatuses for supplying paper to printing presses of the type adopted to print a plurality of independent paper webs simultaneously.

Another object of the invention is to provide improved apparatuses for adding paper to partially consumed rolls of paper mounted on printing press supply roll stands.

Yet another object of the invention is to provide apparatuses for supplying paper from a plurality of roll stands to a plurality of individual press units without premature consumption of paper from any one roll stand, and which apparatuses are relatively easy to operate, efficient, inexpensive, light in weight and small in size.

SUMMARY OF THE INVENTION

In one form of the invention apparatus is provided for supplying paper to a printing press having a plurality of presses for simultaneously printing a plurality of paper webs, and power train means for transmitting power to the presses. The apparatus comprises a plurality of paper roll supports with at least one support including a rotatable shaft, and means for coupling the one roll support rotatable shaft with the power train means for winding paper onto the one roll support from another roll support.

In another form of the invention a printing apparatus is provided comprising a plurality of printing presses, a plurality of paper roll supports, a motor, and a power train coupled with the motor. Means are further provided for coupling the printing presses and one of the paper roll supports with the power train.

BRIEF DESCRIPTION OF THE DRAWING

The drawing consists of two figures providing side views in elevation of a machine embodying principles of the invention in one preferred form in two differing paper supply conditions.

DETAILED DESCRIPTION OF THE DRAWING

Figure 2:
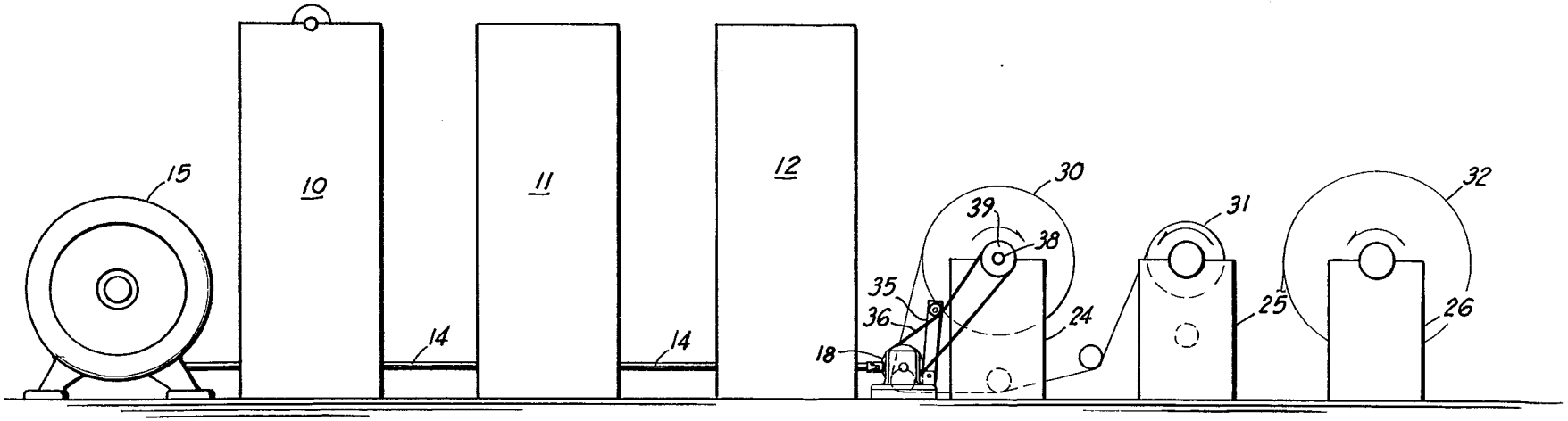

Referring now in more detail to the drawing, there is illustrated printing apparatus which includes three individual printing presses 10, 11 and 12 driven by a power train which includes a segmented drive shaft 14 coupled with the output shaft of an electric motor 15. A right angle gear box 18 is joined with the end of drive shaft 14 while bevel gears 20 couple each press through clutch means 22 with the drive shaft. Three roll stands 24, 25 and 26 are mounted in series to the rear of the gear box. A set of paper guide rollers 28 are provided for guiding paper in web form from rolls 30, 31 and 32 rotatably supported upon the three roll stands to the three presses, respectively. A belt tensioning arm 35 is mounted adjacent gear box 18 for tensioning a belt 36 seated on a pulley 39 secured to an end of a rotatable shaft 38 supported upon roll stand 24 in coupling the shaft with the gear box as shown in FIG. 2. In this manner motor 15 may be used to drive shaft 38. Roll stands 25 and 26 are also provided with rotatable roll support shafts 39 and 40, respectively.

Figure 1:
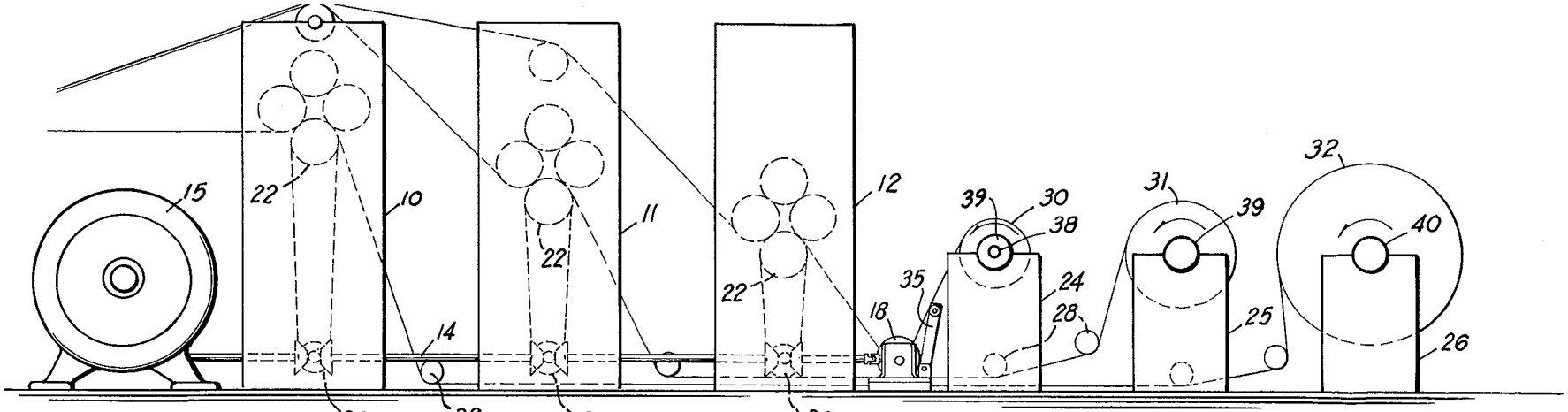

In operation, rolls of paper webs are rotatably mounted upon the three roll stands and the paper from each roll fed through one of the three presses. Clutches 22 are engaged and motor 15 energized thereby driving the power train and presses. During the press run the clutch means provided by belt tensioning arm 35 is disengaged whereby belt 36 is disposed loosely about shaft 38 and gear box 18. Alternatively, the belt is completely removed as shown in FIG. 1. During the press run paper is continuously fed off each of the three rolls 30, 31 and 32 through presses 10, 11 and 12.

At the conclusion of a run the supply of paper mounted to each roll may be of different quantity of such as illustrated in FIG. 1 wherein roll 30 is seen to be of less quantity than roll 31 which in turn is of less quantity than roll 32. With this supply condition it would be necessary to terminate a new press run prematurely were roll 30 alone insufficient. To avoid this problem the paper webs entering presses 11 and 12 are severed and the ends of rolls 30 and 31 taped together such as with splicing tape number 465 sold by the 3M Corporation. Clutches 22 are then engaged and tensioning arm 35 moved clockwise to tension belt 36. The tensioning of this belt serves to couple rotatable shaft 38 with the power train to drive the shaft and roll of paper supported thereon in a reverse direction from that of its paper feeding mode of operation once motor 15 is energized.

With the paper from roll 31 spliced to the end of the paper of roll 30 paper from roll 31 is fed onto roll stand 24. FIG. 2 illustrates a transient condition of the three rolls during this operation. Once the paper is entirely depleted from roll stand 25 a relatively large supply of paper is supported upon roll stands 24 and 26 and stand 25 is vacant ready to receive a fresh, full roll of paper. Tensioning arm 35 may then be moved in a counterclockwise direction to uncouple shaft 38 from the power train, and clutches 22 disengaged to reconnect each of the individual press units with the power train. Paper may then be fed from the three relatively large rolls over guide rollers 28 to the three presses for a new run.

It should be understood that the just described embodiment merely illustrates principles of the invention in one preferred form. Many modifications may, of course, be made to this specifically described form without departure from the spirit and scope of the invention as set forth in the following claims.

What is claimed is:

1. In a printing press having a plurality of presses for simultaneously printing a plurality of paper webs and power train means for transmitting power to the presses, apparatus for supplying paper to the presses with said apparatus comprising a plurality of paper roll supports with at least one support including a rotatable shaft, and means for coupling said one roll support rotatable shaft with said power train means for winding paper onto the one roll support from another of the roll supports.

2. Paper supply apparatus in accordance with claim 1 wherein said coupling means includes a pulley secured to said rotatable shaft and an endless belt seated on said pulley.

3. Paper supply apparatus in accordance with claim 2 comprising belt tensioning means for operatively coupling and uncoupling said one roll support rotatable shaft with said power train means.

4. Paper supply apparatus in accordance with claim 1 wherein said coupling means includes a right angle gear box and means for securing said right angle gear box with the power train means.

5. Printing apparatus comprising, in combination, a plurality of printing presses; a plurality of paper roll supports; a motor; a power train coupled with said motor; and means for alternatively coupling said printing presses and one of said paper roll supports with said power train.

6. Printing apparatus in accordance with claim 5 wherein:

said power train includes a rotatable drive shaft;

said one paper roll support includes a rotatable shaft; and said coupling means includes a right angle gear box connected to said rotatable drive shaft, a pulley secured to said paper roll support rotatable shaft, a belt coupling said pulley with said right angle gear box and means for tensioning said belt.

7. Printing apparatus according to claim 5 wherein said one paper support is driven in a winding direction when said one paper support is coupled to said power train and said one paper roll support is released to rotate in an unwinding direction when said printing presses are coupled to said power train.

8. A method of supplying paper to a plurality of printing presses comprising the steps:

pulling paper into each press from one of a plurality of roll supports during operation of said printing presses;

disconnecting at least a first and a second of said plurality of roll supports from its respective printing press;

rolling paper from said second to said first roll support until said second roll support is empty; and refilling said second roll support with a fresh roll of paper.

9. A method according to claim 8 wherein paper is pulled into said presses by driving said presses with a common drive shaft and paper is rolled from said second to said first roll support by driving a shaft on said first roll support with said common drive shaft.

* * * * *